US005203098A

United States Patent [19]

Perrissoud et al.

[11] Patent Number: 5,203,098

[45] Date of Patent: Apr. 20, 1993

[54] ALPINE SKI BOOT WITH SIDE LATCHING APPARATUS

[75] Inventors: Claude Perrissoud, Saint-Jorioz; Serge Lagier, Rumilly, both of France

[73] Assignee: Salomon S.A., Annecy Cedex, France

[21] Appl. No.: 645,656

[22] Filed: Jan. 25, 1991

[30] Foreign Application Priority Data

Jan. 26, 1990 [FR] France ..... 90 01102

[51] Int. Cl.[5] ..... A43B 5/04

[52] U.S. Cl. ..... 36/117; 36/120

[58] Field of Search ..... 36/117-121, 36/89

[56] References Cited

U.S. PATENT DOCUMENTS

| | | | |
|---|---|---|---|
| 4,186,501 | 2/1980 | Salomon . | |
| 4,882,857 | 11/1989 | Sartor et al. . | |
| 4,901,455 | 2/1990 | Morell et al. | 36/120 |
| 4,944,100 | 7/1990 | Sartor et al. . | |
| 5,001,850 | 3/1991 | Mattiuzzo | 36/121 |
| 5,031,341 | 7/1991 | Paris et al. | 36/120 |
| 5,033,210 | 7/1991 | Dodge et al. | 36/120 |

FOREIGN PATENT DOCUMENTS

| | | | |
|---|---|---|---|
| 255680 | 2/1981 | European Pat. Off. . | |
| 3219772 | 1/1983 | Fed. Rep. of Germany | 36/120 |
| 2371162 | 6/1978 | France . | |
| 2433311 | 4/1980 | France | 36/121 |
| 1087581 | 11/1977 | Italy . | |

*Primary Examiner*—Jimmy G. Foster
*Assistant Examiner*—Thomas P. Hilliard
*Attorney, Agent, or Firm*—Sandler, Greenblum & Bernstein

[57] ABSTRACT

Alpine ski boot whose upper has a rear collar for tightening the lower leg, journalled around an axis connecting it to shell base in the zone of the heel. The collar is retained and connected, in the position of closure of the upper, along a predetermined inclination with respect to the shell base by a latching apparatus including lateral rigidifying elements adjustable in relative position on the shell base.

14 Claims, 4 Drawing Sheets

FIG. 2
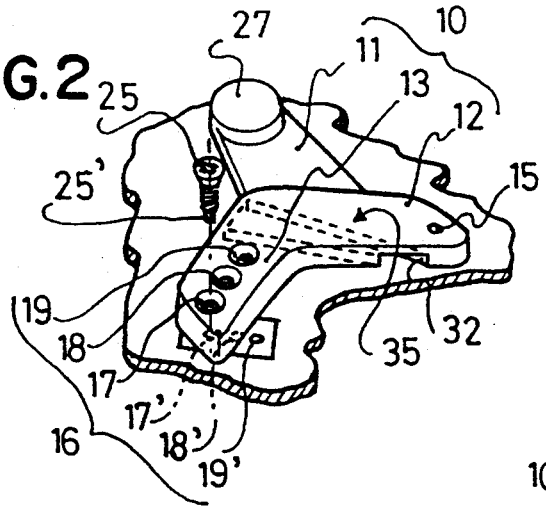
FIG. 1
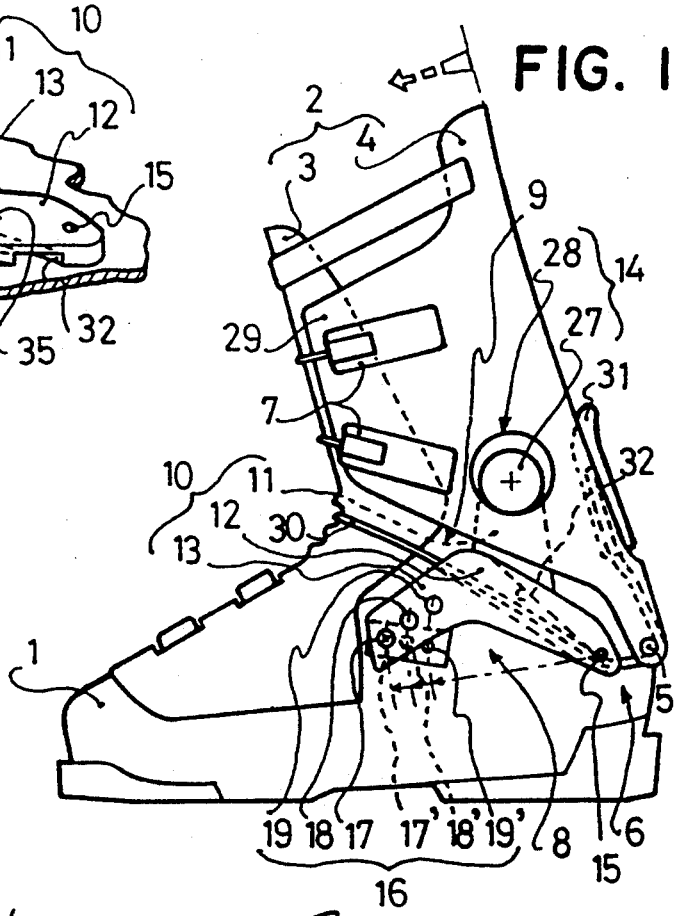
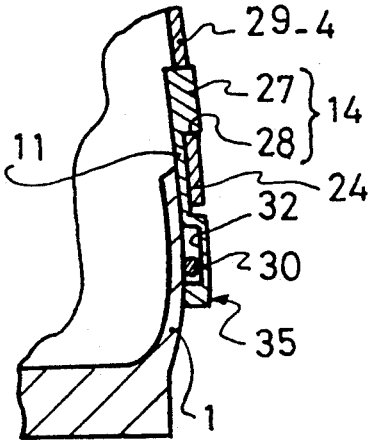
FIG. 4
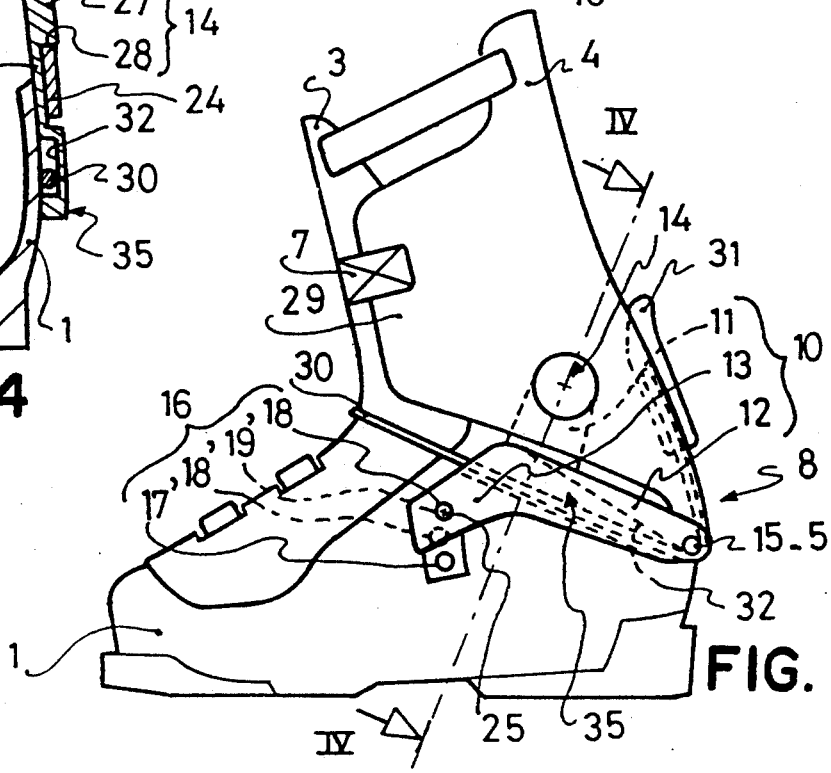
FIG. 3

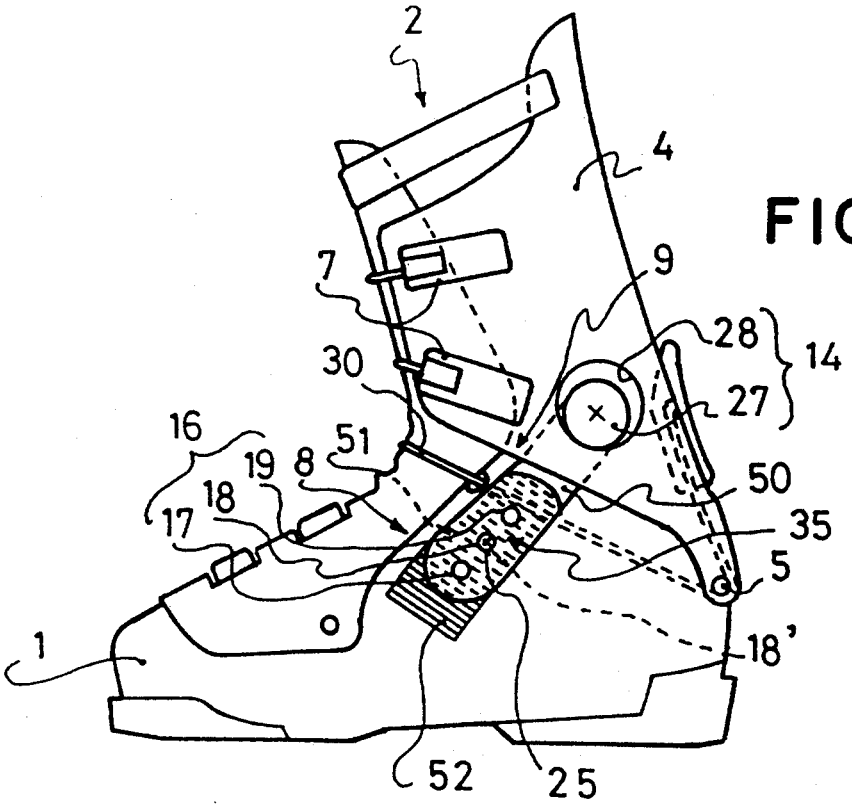
FIG. 7
FIG. 7a
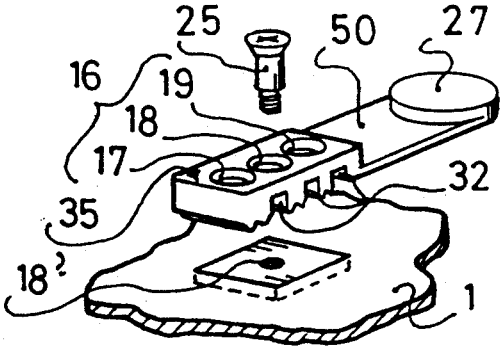
FIG. 7b
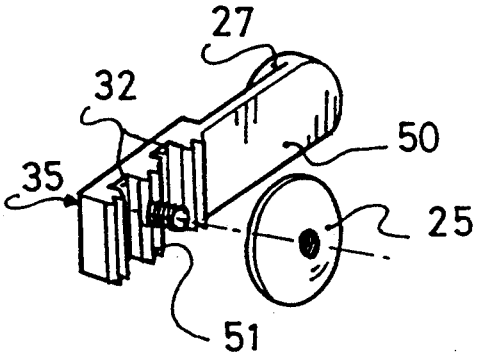
FIG. 7c
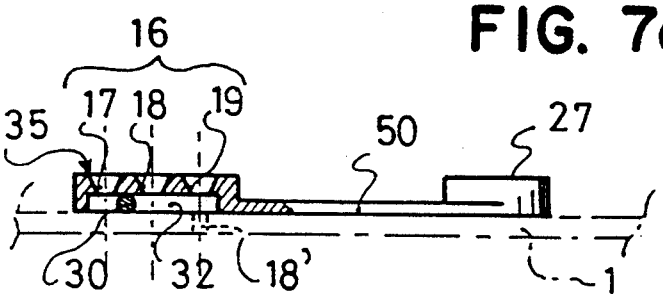

ALPINE SKI BOOT WITH SIDE LATCHING APPARATUS

BACKGROUND OF THE INVENTION

1. Field of the Invention

The present invention relates to alpine ski boots whose upper is at least partially journalled with respect to the shell base and relates more particularly to boots comprising a rear spoiler or tightening collar, for the lower leg pivotably mounted in the zone of the heel on the shell base and angularly blockable with respect to the latter in the position of closure of the upper.

2. Description of Background and Relative Information

Known ski boots of this type have a tightening collar of for the lower leg which is angularly blockable with respect to the shell base in the front-rear direction by means of a latching apparatus positioned for a portion on the collar and for another portion on upper and lateral extensions of the shell base extending in the zone superior to the malleoli. One can in particular cite ski boot models in which the latching apparatus is constituted by a projection, carried by the extensions of the shell base and by a corresponding nesting opening provided on the collar, such as is taught in Italian Patent 1,087,581. In these boots the wings of the collar are spaced render the latching apparatus inoperative and allow for the rocking of the collar towards the rear for putting on and taking off the boot. Conversely, by maintaining the wings of the collar tightened on the extensions of the shell base by means of the closure system of the upper on the lower leg, the latching apparatus then blocks the collar with respect to the shell base in extreme angular position for retention of the lower leg of the skier in the front-rear direction. It follows that the quality of the rearward support of the lower leg on the collar is dependent upon the rigidity of the closure system of the upper, of the vertical extensions of the shell base and of the tightening collar for the lower leg.

Thus, for these types of boots, the tightening and/or retention functions of the lower leg which the various constituent portions of the boots must fulfill are not always achieved in a satisfactory manner for the skier. In effect, the different constituent portions of the upper must have contradictory characteristics to achieve the functions explained above. Yet, the existing boots illustrate that their constructional arrangements only imperfectly have such contradictory characteristics, such that one of the functions sought is achieved to the detriment of the other. Thus, the latching apparatus positioned at the level of the upper flexible extensions of the shell base does not make it possible to obtain the rigidity of the upper which is sought during skiing. This phenomenon is further often aggravated by virtue of the fact that the extensions of the shell base are covered by the wings of the collar which are necessarily flexible. Furthermore, the lower edges of these wings, which are generally raised on the sides of the boot, are exposed to ski edge hits during skiing. Finally, the latching apparatus being situated in a fixed manner on the vertical extensions of the shell base and on the wings of the collar, the angular retention position of the lower leg of the skier in the front-rear position is determined in an unalterable manner, which does not allow for an personalized adaptation responding to the requirements of advanced skiers in particular.

SUMMARY OF THE INVENTION

An object of the present invention is to provide a ski boot type having a collar journalled towards the rear, whose upper assures both a good rigidity in the position of use during skiing and a good suppleness and deformation of the walls so as to wrap and hold the foot after insertion of the foot. For this purpose, the collar of the boot according to the invention is adapted to cooperate with two lateral rigidifying elements applied on each side of the shell base.

An object of the present invention is to assure the latching of the collar of the lower leg in a constant angular position of latching of the upper while allowing for an easy preadjustment of this angular, closure position with respect to the shell base.

Another object of the invention is to protect the sides of the boot, i.e., the collar, from a premature wear due in particular to being hit by the skie edges. To this end, the invention proposes forming a latching apparatus of the lower leg with the rear collar which is distinct from each of these portions of the boot and applied in an adjustable manner thereon to connect them together in a zone in front of the heel approximately at the level of the malleoli at variable angular positions.

The ski boot according to the invention comprises a shell base capped by an upper which is at least partially journalled on the latter. This upper is constituted by a front portion, or front cuff or spoiler, made in one piece with the shell base or applied thereto, and a rearward portion, or rear collar, journalled around a transverse axis connecting it to the shell base in the zone of the heel. A closure system of the upper on the lower leg is associated with the front and rear portions thereof and assures their maintenance in position during skiing. According to the invention, a latching apparatus, distinct from the shell base and the upper, and comprising two rigidifying elements, cooperates with the rear. collar to secure the latter in a constant position of latching of the upper and to retain it in this position with respect to the shell base along a predetermined inclination. The rigidifying elements of the latching apparatus which extend on the sides of the boot connect the rear collar to the shell base in front of the journal axis of the rear collar on the latter and in the zone close to the malleoli. To this end, the rigidifying elements are fixed, on the one hand, to the shell base at least at a point positioned in front of the malleoli and, on the other hand, cooperates with the collar at a point positioned above the malleoli.

According to one characteristic of invention, the rigidifying element and the shell comprise elements for adjusting their reciprocal position in the vertical direction, by spacing or approaching the sole of the boot. These adjustment elements are associated with a removable assembly system connecting the rigidifying elements to the shell base.

According to another characteristic of the invention, the rigidifying elements of the latching apparatus comprise an elastic deformation zone active against front-rear flexional movement, and vice-versa, the rear collar around its journal axis from its position of retention of closure of the upper. According to an alternative embodiment, the deformation zone of the rigidifying elements is active only in the direction of rear-front flexions.

Likewise, according to the invention, each of the rigidifying elements of the latching apparatus is characterized in that it has a boss which projects with respect to the corresponding side of the boot, in the zone extending under the lower edge of,the collar, in the direction of the sole of the boot. This boss is preferably constituted of a material of high resistance to abrasion and is positioned on the side directed towards the exterior of the boot.

Other characteristics of the rigidifying elements covering at least partially the linkage elements participating in retention of the foot, such as cables or linkages, which can run along the exterior of the shell base. To this end, the rigidifying elements are preferably provided with at least one guide channel and/or protection channel corresponding to the passage of the linkage elements which is thus covered and protected.

According to one preferred embodiment of the invention, the rear collar of the upper comprises in its upper portion transverse wings which extend in the direction of the front cuff which they at least partially cover. These wings are secured to the closure system of the upper on the lower leg and comprise for this purpose attachment means to cooperate with the system. A rear collar is thus adapted to maintain and to bring together the different contingent portions of the upper between them and, by way of consequence, to tighten the lower leg of the skier in the upper of the boot for skiing.

BRIEF DESCRIPTION OF THE DRAWINGS

The above characteristics and different arrangements of the invention will appear more clearly from reading the detailed description which follows with reference to the annexed drawings illustrating, by way of non-limiting example, preferred embodiments thereof, in which:

FIG. 1 is an elevational view of a boot comprising latching apparatus according to the invention;

FIG. 2 illustrates, in partial perspective view, a rigidifying element of the latching apparatus of the boot of FIG. 1;

FIG. 3 illustrates another embodiment of the latching apparatus;

FIG. 4 is a partial cross-sectional view along line IV—IV of the boot of FIG. 3 illustrating position of one of the rigidifying elements of the apparatus with respect to the side of the boot;

FIGS. 7–7*c* illustrate one embodiment of the latching apparatus still according to the invention, FIG. 7 illustrates the boot seen in elevation and FIGS. 7*a*, 7*b* and 7*c* illustrate the embodiments of the rigidifying elements of the latching apparatus;

DESCRIPTION OF PREFERRED EMBODIMENTS

Figure 5:
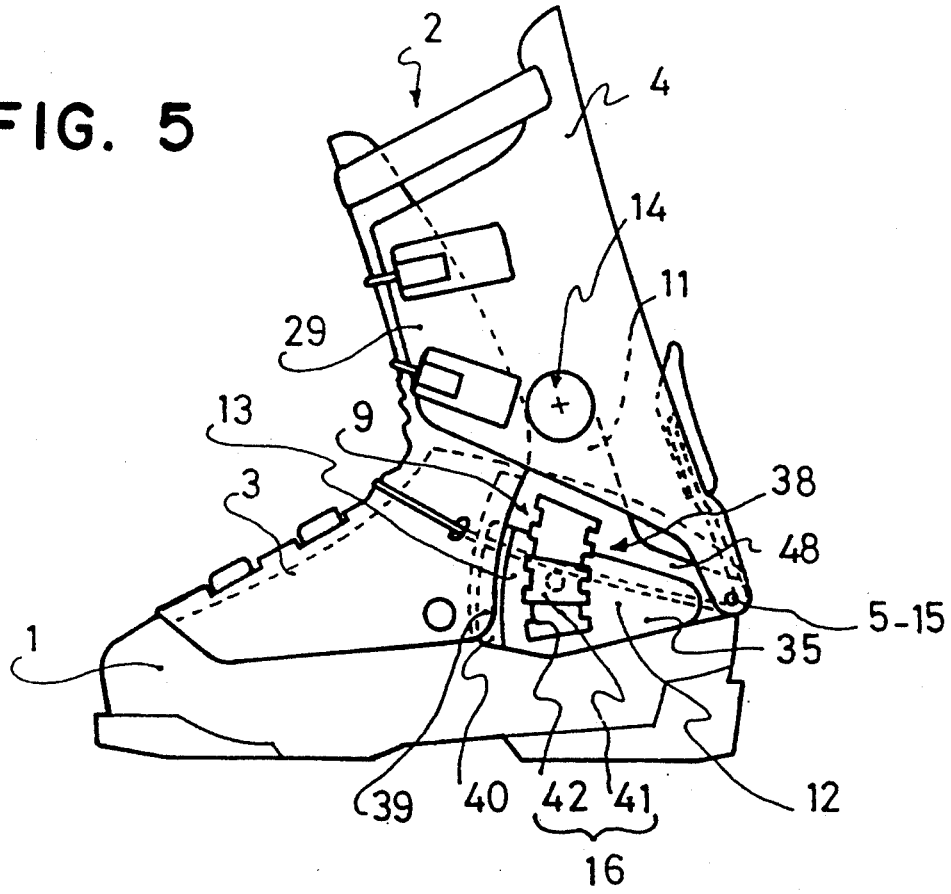
FIGS. 5 and 6 illustrate another embodiment of the latching apparatus.

The ski boot illustrated in FIG. 1 has a shell base 1 capped by an upper 2 comprising a front cuff or spoiler 3 and a tightening collar or rear spoiler 4 lower leg. Collar 4 is journalled around a transverse axis 5 connecting it to shell base 1 in the zone of heel 6. A closure system 7 of a known type, such as "cable stretcher", is associated with collar 4 and cooperates with the front spoiler 3 to insure the coming together and the maintenance of these different contingent portions of the upper 2 against the lower leg of the skier in the skiing position. According to the invention, a latching apparatus 8 is positioned between the collar 4 and the shell base 1 in the front portion of the boot, in front of the journal axis 5 of the collar, approximately in the zone 9 of the malleoli. This latching apparatus 8 comprises a pair of latching mechanisms two rigidifying elements 10 which extend on the sides of the boot and which are provided with a fixed or permanent, linkage means 15 and 25 with shell 1 (FIGS. 1 and 2) and active linkage means 14 with collar 4. In the closed position of the upper 2, shell base 1 and collar 4 are thus connected to one another by means of latching apparatus 8. Conversely, and by opening and disengaging of collar 4, reciprocal release of the latching apparatus and of the collar allows for the insertion and the removal of the foot from the boot.

In the embodiment illustrated in FIGS. 1 and 2, the rigidifying element 10 has the general shape of a star having 3 arms, 11, 12 and 13 and is connected to shell base 1, on the one hand, by means of a non-removeable linkage 15 such as pivot pin or a rivet at the level of arm 12 and, on the other hand, by another linkage element 25 which is removable such as a screw at the level of arm 13. The linkage of the ridigifying element 10 with collar 4 is assured by means of arm 11 which extends above the zone 9 of the malleoli and linkage means 14 constituted by a projection 27, or boss, and a corresponding nesting recess or opening 28 formed in wings 29 of collar 4. This opening 28 is positioned at a distance from the journal axis 5 of collar 4 and on the wings 29 of the collar to not be engaged with projection 27 except in the closure position of upper 2.

According to the invention, the rigidifying element 10 is made adjustable and is positioned on shell base 1 in the vertical direction and comprises for this purpose adjustment elements 16, forming part of an adjustable linkage device, which are associated therewith at the level of arm 13 with removable linkage elements 25 on shell base 1. In this example of construction, the adjustment elements 16 are constituted by a succession of holes 17, 18 and 19 which are spaced along arm 13 in correspondence with another succession of holes 17', 18', 19' formed on shell base 1. These holes are secured between them by a binomial 17—17', 18—18', and 19—19', respectively, by means of linkage element 25 which is removable, constituted by the screw whose end 25' engages in the end of holes 17', 18' or 19' of shell base 1 placed in correspondence therewith. As illustrated i FIG. 1, holes 17' 18' and 19' of shell base 1 are aligned with the rear pivot axis of pin 15 of the rigidifying element 10. In a comparable manner, holes 17, 18 and 19 of the latter are distributed along arm 13 obliquely with respect to holes 17', 18' and 19' at a distance identical to that of the latter, concentrically to the pivot axis or pin 15. Thus, to modify the angular position of the latching apparatus 8 on shell base 1, it suffices first to remove screw 25 to free arm 13 from rigidifying element 10, which can then pivot around its axis 15 and be brought into a new angular position selected and determined by the adjustment holes 17—17', 18—18' and 19—19'. By virtue of the fact that its pivoting is not possible except around axis 15 constituting the retention means of its arm 12, any modification of the angular position of arm 13 with respect to shell base 1 simultaneously causes a corresponding angular modification of arm 11 which, itself, assures the connecting with collar 4 when the latter is in the closed position of the upper 2. As a result, collar 4, to be connected through its wings 29 with latching apparatus 8, must be rocked in the front-rear direction around its journal axis 5 by a certain angular value which is always a function of the preadjustment of the position of the ridigidying elements 10 with respect to shell base 1. Furthermore, to allow pivoting of the ridigifying elements 10 on their rear linkage axis 15 without interfering with linkage means 14 at the level of wings 29 of collar 4, which pivot on its axis 5 positioned at a distance from rigidifying elements 10, the nesting opening 28 provided each of the wings 29 is relatively greater than its projection 27 with which it cooperates.

It is understood, without going beyond the scope of the invention, that the rigidifying elements 10 can be connected to shell base 1 on a linkage axis 15 coinciding with the axis of articulation 5 of collar 4. In one embodiment, shown in FIG. 3 which follows, the adjustment means 16 are preferably defined with respect to the pivot axis 5-15 common to the rigidifying element 10 and to the collar 4. The adjustment holes 17', 18' and 19' formed on shell base 1 are in particular, spaced along the latter concentrically to the pivot axis 5-15 and one of them, 18, of the adjustment holes 17, 18 and 19, previously provided on arm 13 of rigidifying element 10 (FIGS. 1 and 2) is thus maintained for the same adjustment positions. Likewise, since there is only one pivot axis 5-15 to collar 4 and to the rigidifying element 10, the relative play between the projection 27 and the nesting opening 28 of the linkage means 14 is reduced to the strict minimum.

According to another characteristic of the invention, the rigidifying elements 10 of the latching apparatus 8 cover at least partially the linkage elements which participate in the retention of the foot in the boot. Thus, in the boot shown in FIGS. 1 and 3, the cable 30 which participates in the retention of the foot in the zone of the instep, and which is tensioned by means of a stretcher lever 31 positioned on the rear surface of the collar 4, passing in to channel 32 provided in the rigidifying elements 10. This channel 32 comprises a conduit which enlarges from the inlet of cable 30 positioned approximately in the pivot axis 15 of rigidifying element 10 to the zone of the instep. This enlargement of the conduit of channel 32 is such that cable 30 does not deviate in its path along the length of shell base 1, whatever the angular adjustment performed on the rigidifying element 10 with respect to the shell base 1. It can, however, be desirable to obtain a path or trajectory of cable 30 which is modified along the length of shell base 1 to orient the force of the foot retention in a direction which is more or less oblique with respect to the heel and/or the sole of the boot. To this end, the guide channel 32 of cable 30 is then adjusted to the diameter of cable 30 and oriented along a predetermined direction with respect to the adjustment means 16 such that, for an angular adjustment position of the rigidifying element, there results a change in orientation in the direction of the cable for the portion of its length extending beyond the guide channel.

Preferably, as will appear more clearly in FIG. 4, the rigidifying element 10 can have a projection 35, in its portion covering cable 30 in correspondence with channel 32 which projects with respect to the other portions of the boot extending over or in the proximity of the sides as, for example, the lower edge of wings 24 of collar 4. As a result, element 10 participates in the protection of the cable 30 against possible hits by ski edges particularly over the interior side of each boot. For providing this protection against being hit by the edges of the skis, projection 35 preferably comprises a surface having a high resistance to abrasion and wear on the side directed toward the exterior, a wear surface which can be constituted by a surface treatment, a thermal treatment, a deposit such as a film, etc., or by an element made out of a specific material applied by any known means such as gluing, welding, mechanical assembly, etc. on the projection.

Figure 6:
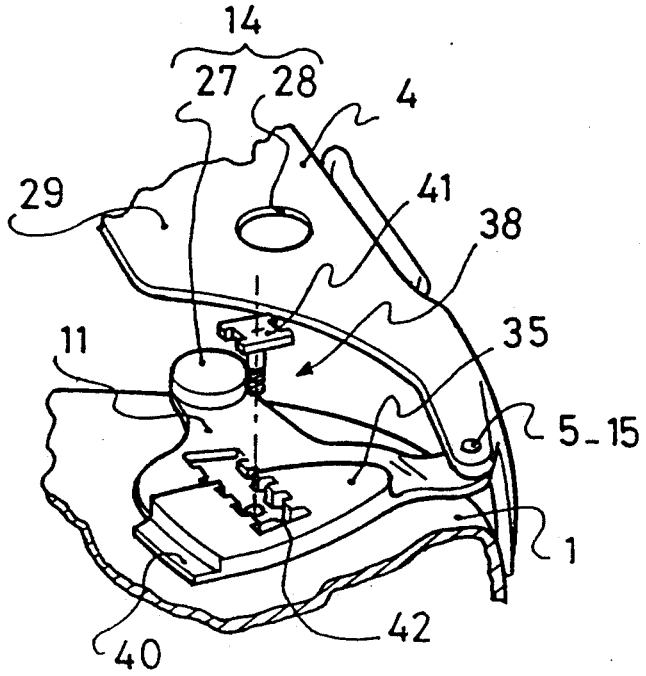

In FIGS. 5 and 6 which follow, the ski boot has a latching apparatus 38 of collar 4, on shell base 1 in the closed position of upper 2 of an embodiment having three arms comparable to latching apparatus 8 of FIGS. 1-4 which have preceded, but which the front linkage axis 25 is replaced, on the one hand, by a rear edge 39 of the front spoiler or front cuff 3 which cooperates with a front edge 40 of the rigidifying element 48 and, on the other hand, by a tooth-pin 41 which cooperates with a rack 42 which is concentric to the common pivot axis 5-15 of collar 4 and element 48. As it appears, edge 39 of cuff 3 retains the rigidifying element 48 against the side of the boot on the shell base 1 while the tooth-pin 41 with its rack 42 constitutes in fact the adjustment element 16 and blocks the element 48 in the selected angular position. The removable front linkage means is thus cOnstituted by the edge assembly 40 - 39 associated with pin 41 - rack 42. It is understood that the particular provisions previously described such as projection 35 and/or channel 32 for guiding and protection of a cable, or any other element running on the shell base, can likewise be provided on the rigidifying element 48.

According to an alternative embodiment of the invention shown FIG. 7, the latching apparatus 8 can be described simply as a rigidifying element 50 whose relative position with respect to the shell base 1 is modifiable by means of adjustment means 16. This rigidifying element is connected to the side of the shell base 1 in the front portion of the boot by means of a linkage 25 which is removable and which cooperates with succession of holes 17, 18, 19. These holes constituting a portion of means 16 are formed at the lower end of the rectilinear rigidifying element. The linkage means 25 is adapted to be lodged in one of the holes 17, 18, and 19 to cooperate then with a connection hole 18' carried by the shell base. At the other end, the rigidifying element is connected to the collar 4 by means of active linkage means 14 alone when the collar is in the closure position of the upper 2. In this embodiment, the adjustment means 16 of the rigidifying element 50 with respect to the shell base 1 are constituted by the succession of holes 17, 18, 19 associated with connection hole 18' and by means of removable linkage means 25. To guarantee an inclined stable and constant position to the rigidifying element 50 on shell base 1, in particular to facilitate its connection with the collar 4 when the latter is brought to the closure position of the upper 2, a succession of teeth 51 is provided on the rigidifying element 50, which are applied against the shell base 1 which is then provided with complementary teeth 52. Preferably, teeth 51 and 52 are oriented along a direction perpendicular to that of the forces of collar 4 and are adapted to transmit forces of the rigidifying element 50 during the flexional bias toward the front and/or toward the rear. Such an immobilization of the rigidifying element 50 on shell base does not make it possible to follow the trajectory during pivoting of the nesting opening 28 with respect to the rectilinear trajectory of the projection 27 carried by the rigidifying element 50 between two preadjustment positions, the connection by means 14 is thus provided with relative play absorbing this difference between the trajectories.

Figure 9:
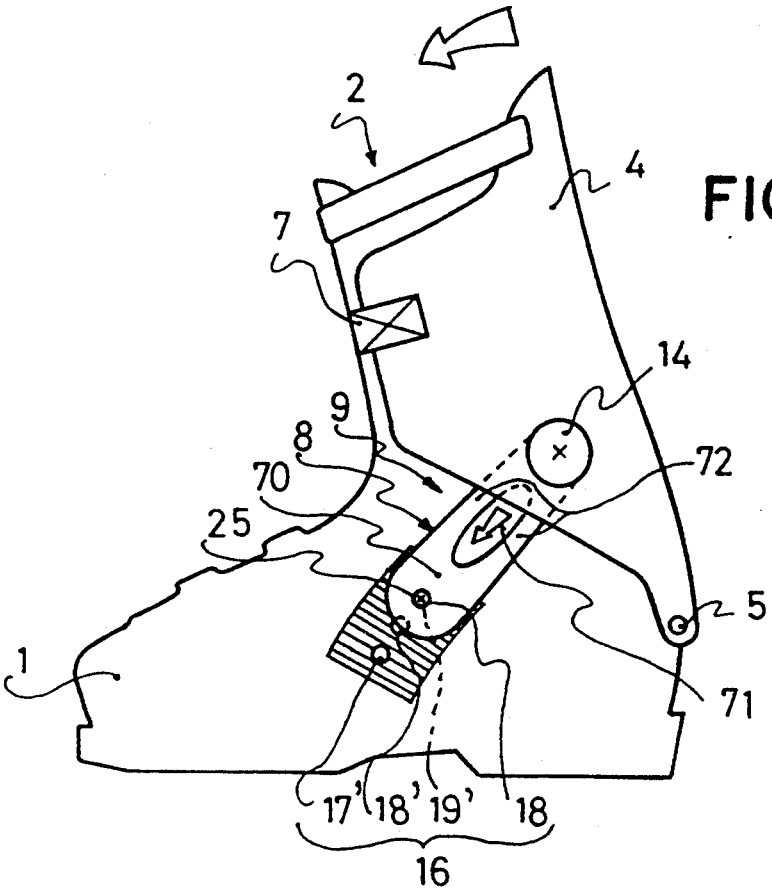

In the embodiment of FIG. 7, rigidifying element 50 simply comprising a projection 35 which protects against hits from the ski edges but can also, as is illustrated in FIGS. *7a*, *7b*, and *7c* which follow, be provided with at least one guide channel 32 for the possible passage of a cable 30. Furthermore, the rigidifying element 50 which is provided with three adjustment holes, respectively 17, 18, and 19, while the shell base 1 has only hole, 18' (visible in FIG. 7, *7a*, and *7c*), can also be formed with a single connec-tion hole cooperating with a linkage means 25. It is thus the shell base 1 which carries the three adjustment holes (FIG. 9). In the embodiment shown in FIG. *7b*, rigidifying element 50 comprises a threaded pin, unitary therewith, and the linkage means 25 is then constituted by an assembly a bolt passed within the shell base 1 and screwed on this threaded pin which extends through the adjustment hole selected from amongst 17', 18' or 19' carried by the shell base. It is self evident that the preadjustment positions of the latching apparatus 8 with respect to shell base 1 can be less than or greater than three, as has been previously described without going beyond the scope of the invention.

Finally, the different embodiments of the invention previously described have adjustment means 16 positioned between the rigidifying element 10, 48, or 50 and the shell base 1 by virtue of the fact that the closure system 7 of collar 4 assures the latching of its active linkage means 14 but does not exclude, of course, the possibility of simple transposition of these means 16 between the rigidifying element 10, 48, 50 and the collar 4, a closure system equivalent to 7 being then preferably associated by means of the active linkage 14 which is positioned in this case on shell base 1.

Figure 8:
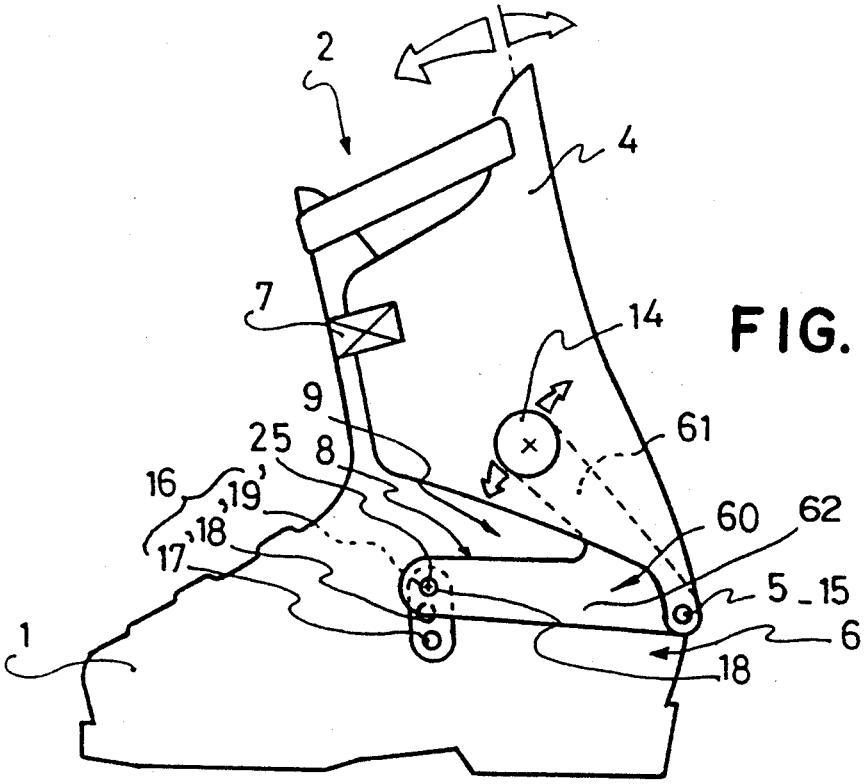
FIGS. 8 and 9 illustrate embodiments of latching apparatus still according to the invention provided with an active elastic deformation zone against flexion movements of the rear collar with respect to the shell base.

Furthermore, as is shown in FIGS. 8 and 9 which follow, the latching apparatus 8 can be adapted to participate in the control of the flexion of the upper 2 with respect to shell base 1, i.e., to oppose a certain elastic resistance to the movements of the latter at least in the rear-front direction.

In the first example of the boot illustrated in FIG. 8, the latching apparatus 8 comprises a rigidifying element 60 whose general shape is in the form of "V" lying on one arm 62 of its two arms 61 and 62, which is connected to the shell base 1 at its intersection with an arm 61, by permanent linkage means 15, and at its free end, by adjustable linkage means 25. These linkage means 15, 25 are positioned on the lower arm 62, while the upper arm 61 carries the active linkage means 14 cooperating with the collar 4. The arm 61 of the rigidifying element 60 preferably constitutes a beam having a certain degree of deformation in the direction of front-rear flexion and vice versa.

In the second embodiment of the boot illustrated in FIG. 9, the latching apparatus 8 comprises a rigidifying element 70 provided with an interior opening 71 which defines two bridges 72 which are deformable only in spacing. As a result, when the rigidifying element 70 is biased in compression, its bridges 72 undergo a certain degree of deformation in spacing, resulting in a flexional force in the front-rear direction.

The instant application claims the priority of French Application 90 01102, filed Jan. 26, 1990, the disclosure of which is hereby incorporated by reference thereto.

Finally, although the invention has been described with reference to particular means, materials and embodiments, it is to be understood that the invention is not limited to the particulars disclosed and extends to all equivalence within the scope of the claims.

What is claimed is:

1. A ski boot comprising:

a shell base having a heel portion and a pair of side portions;

an upper comprising a rear collar;

a pivot journal connecting said rear collar for pivoting at said heel portion of said shell base between a rearward position and a forward latched position;

a closure system for closing the upper on the lower leg of a skier;

a latching apparatus for latching said upper with respect to said shell base in said forward latched position and for unlatching said upper with respect to said shell base to allow movement of said rear collar toward said rearward position, and wherein:

said latching apparatus comprises an apparatus distinct from said shell base and said upper;

said latching apparatus is located in a zone of the malleoli of the skier;

said latching apparatus is connected to said shell base at an area of said shell base forward of the malleoli of said skier;

said latching apparatus is connected to said rear collar at said upper at an area of said rear collar above the malleoli of said skier in said forward latching position of said rear collar;

said latching apparatus comprises a rigidifying element on each of said pair of side portions of said shell base, each of said rigidifying elements comprising:

at least one fixed linkage device fixedly linking each of said rigidifying elements to said shell base at a predeterminate location; and a further linkage device for linking said rigidifying element to said rear collar in said forward latched position;

said rear collar comprises a pair of wings, each of said wings having an opening therein;

each of said further linkage devices comprises a projection located for nesting within a respective one of said openings in said wings of said rear collar in said forward latched position of said rear collar;

at least one of said at least one fixed linkage device comprises a removable linkage element; and each of said rigidifying elements further comprises an adjustable linkage device for fixedly linking a respective one of said rigidifying elements at a selected one of a plurality of different positions with respect to said shell base by means of said removable linkage element.

2. The ski boot as defined in claim 1, wherein:

each of said rigidifying elements is mounted for movement in a generally vertical plane; and each of said ajdustable linkage devices further comprises means on said shell base for selective engagement with a respective one of said rigidifying elements for said fixedly linking a respective one of said rigidifying elements at a selected one of a plurality of different positions with respect to said shell base.

3. The ski boot as defined by claim 2, wherein:
said at least one fixed linkage device further comprises a non-removable linkage element;
each of said rigidifying elements is pivotally mounted to said shell base in said generally vertical plane about said non-removable linkage elements; and
each of said rigidifying elements is adjustably affixed at said selected one of a plurality of different positions with rsepect to said shell base by means of said removable linkage element engaging with said means for selective engagement of said shell base.

4. The ski boot as defined in claim 3, wherein:
each of said rigidifying elements comprises three arms;
a first of said three arms connects a respective one of said rigidifying elements to said shell base in said heel portion of said shell base by means of said non-removable linkage element;
a second of said three arms connects sai respective one of said rigidifying elements to said shell base forward of the zone of the malleoli of the skier by means of said removable linkage element; and
a third of said three arms connects said respective one of said rigidifying elements to said rear collar above the zone of the malleoli of the skier by means of said further linkage device.

5. The ski boot as defined by claim 4, wherein:
each of said means on said shell base for permitting selective engagement of said shell base with a respective one of said rigidifying elements comprises a series of holes in said shell base centered with respect to said non-removable linkage element;
each of said adjustable linkage devices further comprises a series of holes in said second of said three arms; and
one each of said series of holes in said shell base and said series of holes in said second arm being selectively connected by means of said removable linkage element.

6. The ski boot as defined by claim 3, wherein:
said upper further comprises a front cuff;
each of said rigidifying elements comprises three arms;
a first of sid three arms connects a respective one of said rigidifying elements to said shell base in said heel portion of said shell base by means of said non-removable linkage element;
a second of said three arms connects said respective one of said rigidifying elements to said shell base forward of the zone of the malleoli of the skier by means of a front edge of the rigidifying element cooperating with a rear edge of the front cuff of the upper and by means of a toothed pin connected to said shell base and a rack formed in said second arm; and
said toothed pin and said rack constituting at least a part of said adjustable linkage device.

7. The ski boot as defined by claim 3, wherein:
each of said rigidifying elements is generally V-shaped, in which a first arm and a second arm meet at an area of intersection, each of said V-shaped rigidifying elements being connected to said shell base at said area of intersection in the heel portion of said shell base by means of said non-removable linkage element;
said first arm has a free end connected to said shell base forward of said malleoli of the skier by means of said removable linkage element in cooperation with said adjustable linkage device; and
said second arm has a free end connected to said rear collar of said upper by means of said further linkage device.

8. The ski boot as defined by claim 2, wherein:
each of said rigidifying elements has a generally rectilinear shape, extending in a direction from said removable linkage element, that cooperates with said adjustable linkage device, to said further linkage device at the rear collar; and
said means on said shell base for permitting selective engagement of said shell base with a respective one of said rigidifying elements comprises means for said fixedly linking a respective one of said rigidifying elements at a selected one of a plurality of different positions aligned along said direction in which said rectilinearly shaped rigidifying element extends.

9. The ski boot as defined by claim 8, wherein:
said adjustable linkage device further comprises a series of holes adjacent a lowermost end of said respective one of said rigidifying elements and a succession of teeth located on a surface of said respective one of said rigidifying elements at said lowermost end;
said means on said shell base for permitting selective engagement of said shell base with a respective one of said rigidifying elements further comprises at least one connection hole and a succession of teeth for selective engagement with said succession of teeth on said respective rigidifying element; and
said respective rigidifying element and said shell base are secured in a selective position among a plurality of predeterminate positions by means of said removable linkage element extending between one of said at least one connection hole of said shell base and one of said series of holes of said respective rigidifying element.

10. The ski boot as defined by claim 2, further comprising:
an elongated linkae element for retention of teh foot, wherein:
each of said rigidifying elements further comprises a passage through which said elongated linkage element extends;
said passage is open on a side of said rigidifying element facing a side of the ski boot and extending at least partially between the non-removable linkage element and an instep zone of the ski boot.

11. The ski boot as defined by claim 10, wherein:
said passage has a width that enlarges in a direction from an inlet proximate said non-removable linkate element, in which said width is a first value, toward said instep zone, in which said width is a second value;
said second value corresponds generally to a range of possible adjustment of said rigidifying element with respect to said shell base by means of said adjustable linkage device.

12. The ski boot as defined by claim 10, wherein:
said elongated linkage element has a predeterminate diameter;
said passage has a width that generally corresponds to said diameter of said elongated linkage element, whereby a change in orientation of said elongated linkage element results from an adjustment of said rigidifying element with respect to said shell base by means of said adjustable linkage device.

13. The ski boot as defined by claim 12, wherein:

each of said rigidifying elements comprises a projection that extends away from respective side portions, said projection being made form a high abrasion-resistant material.

14. The ski boot as defined by claim 13, wherein:

said projection is positioned over said passage and thereby comprises a protection element for said elongated linkage element.

* * * * *